United States Patent [19]

Chancellor, Jr.

[11] Patent Number: 4,768,650

[45] Date of Patent: Sep. 6, 1988

[54] GOLF BAG

[76] Inventor: Charles W. Chancellor, Jr., P.O. Box 15, Midland, Tex. 79702

[21] Appl. No.: 51,827

[22] Filed: May 20, 1987

[51] Int. Cl.[4] ..... A63B 55/00; A45C 13/26

[52] U.S. Cl. ..... 206/315.3; 206/315.5; 206/315.6; 224/264

[58] Field of Search ..... 206/315.2–315.8; 224/264; 190/115

[56] References Cited

U.S. PATENT DOCUMENTS

| | | | |
|---|---|---|---|
| 1,227,657 | 5/1917 | Pierce | 206/315.6 |
| 1,437,349 | 11/1922 | Moore, Jr. | 206/315.6 |
| 1,492,253 | 4/1924 | Levine | 206/315.6 |
| 1,570,500 | 1/1926 | Kennedy | 206/315.6 |
| 1,628,186 | 5/1927 | Pierce et al. | 206/315.3 |
| 1,659,269 | 2/1928 | Hotze | 206/315.7 |
| 1,795,880 | 3/1931 | Mullins | 206/315.4 X |
| 1,840,663 | 1/1932 | Gallagher | 206/315.6 |
| 1,936,021 | 11/1933 | Hutchinson | 206/315.3 |
| 1,951,158 | 3/1934 | Locke et al. | 206/315.6 X |
| 2,064,542 | 12/1936 | Jones | 206/315.6 |
| 2,105,853 | 1/1938 | Brodie | 206/315.6 |
| 2,392,926 | 1/1946 | Kelly | 190/115 |
| 2,507,249 | 5/1950 | Dorazio | 206/315.8 |
| 2,751,955 | 6/1956 | Nahon | 206/315.6 |
| 2,760,782 | 8/1956 | Hartzell | 206/315.6 X |
| 2,861,614 | 11/1958 | Kish, Jr. | 206/315.5 X |
| 2,866,490 | 12/1958 | Thompson | 206/315.6 X |
| 3,139,132 | 6/1964 | Shiller | 206/315.6 |
| 4,111,248 | 9/1978 | Leichhardt | 206/315.6 |
| 4,130,153 | 12/1978 | Zopf | 206/315.6 |
| 4,181,167 | 1/1980 | Ret | 206/315.6 |
| 4,200,131 | 4/1980 | Chitwood et al. | 206/315.6 |
| 4,227,559 | 10/1980 | Stroman | 206/315.6 |
| 4,311,178 | 1/1982 | Kennedy | 206/315.6 |
| 4,332,283 | 6/1982 | Rader | 206/315.6 |
| 4,350,194 | 9/1982 | Brown | 206/315.5 |

FOREIGN PATENT DOCUMENTS

| | | | |
|---|---|---|---|
| 16422 | of 1913 | United Kingdom | 206/315.2 |
| 207317 | 11/1923 | United Kingdom | 206/315.5 |
| 705115 | 3/1954 | United Kingdom | 206/315.5 |

*Primary Examiner*—William Price
*Assistant Examiner*—Sue A. Weaver
*Attorney, Agent, or Firm*—Fleit, Jacobson, Cohn & Price

[57] ABSTRACT

A golf bag which is adaptable for carrying or for cart use has a length-adjustable shoulder strap assembly with a slotted shoulder pad. The shoulder strap can be shortened to a configuration in which it lies flush against the bag exterior and a rigid carrying handle secured to the bag protrudes through the slot in the shoulder pad. Other features of the bag include a shock absorbing rubber bumper ring on the base and a magnetic bag top for magnetically attracting steel-shaft clubs stowed in the bag to organized engagement around the rim.

15 Claims, 2 Drawing Sheets

GOLF BAG

BACKGROUND AND SUMMARY OF THE INVENTION

This invention relates to golf bags and more particularly to a novel golf bag construction which makes the bag readily adaptable for carrying and for use on a golf cart. Further, golf bags in accordance with the invention include certain unique features not found in conventional bags.

A golf bag in accordance with the invention, for example, includes a support tube of selected diameter, for example, 8 inches for smaller bags or 10-½ inches for larger bags, which may, for example, be fabricated from lightweight metal sheet, and which forms the main club storage compartment of the bag. The tube may be covered with any suitable fabric cover which may include storage pockets on three sides and an adjustable-length shoulder strap on the fourth side. The shoulder strap may include a shoulder pad portion which is slotted to receive a rigid carrying handle attached to and projecting outwardly from the bag body, so that when the shoulder strap is adjusted to its shortest length, it lies substantially flat against the outside of the bag with the handle protruding through the slot in the shoulder portion. In another embodiment, the carrying handle may be secured directly to the outside of the shoulder pad.

The bag may include a cushioned double-bottom constrcction including a shock absorbing ring of rubber or like resilient material to cushion shocks when the bag is impacted against a surface, and to cushion the club handles against shock. The tube interior may be partitioned by suspended club dividers supported on bars attached to a suspension ring adjacent the top of the tube. Further, the topmost ring section of the tube may be magnetized so as to provide a retainer which holds steel-shafted clubs against the tube in circumferentially spaced and organized positions. The bag may further include a chain and snap hook for securing the bag on a golf cart in place of conventional cart straps normally used for this purpose.

While numerous golf bag designs are currectly available, applicant is unaware of any golf bag having the particular structural features of the present invention. Examples of previous golf bag designs may be found in the following U.S. Pat. Nos.

1,628,186: May 10, 1927
1,936,021: Nov. 21, 1933
2,437,405: Mar. 9, 1948
2,861,614: Nov. 25, 1958
4,181,167: Nov. 1, 1980
4,266,589: May 12, 1981
4,332,283: June 1, 1982
4,350,194: Sept. 21, 1982

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
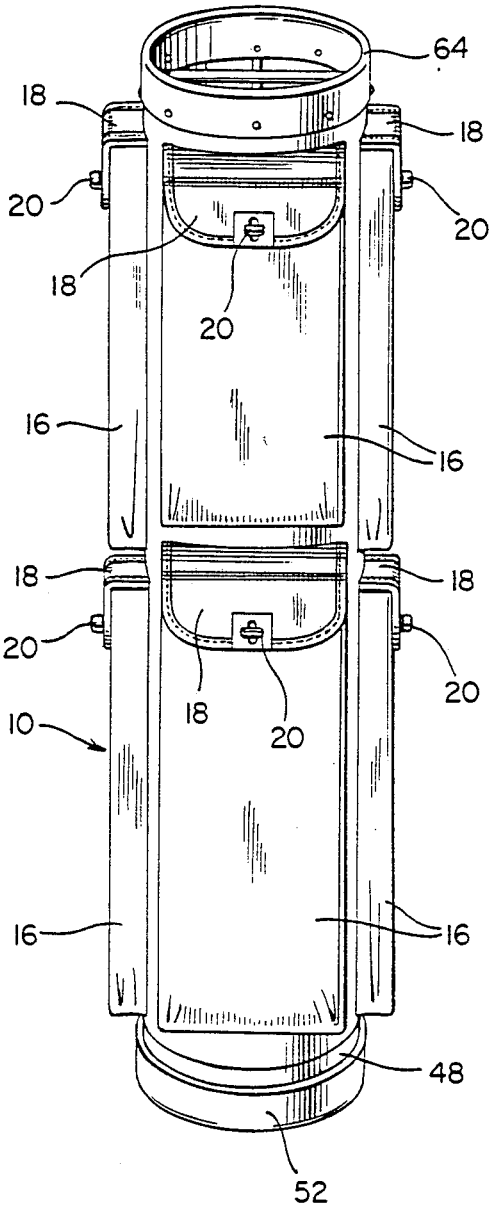
FIG. 1 is a perspective view, from one side, of a golf bag in accordance with the invention.
Figure 2:
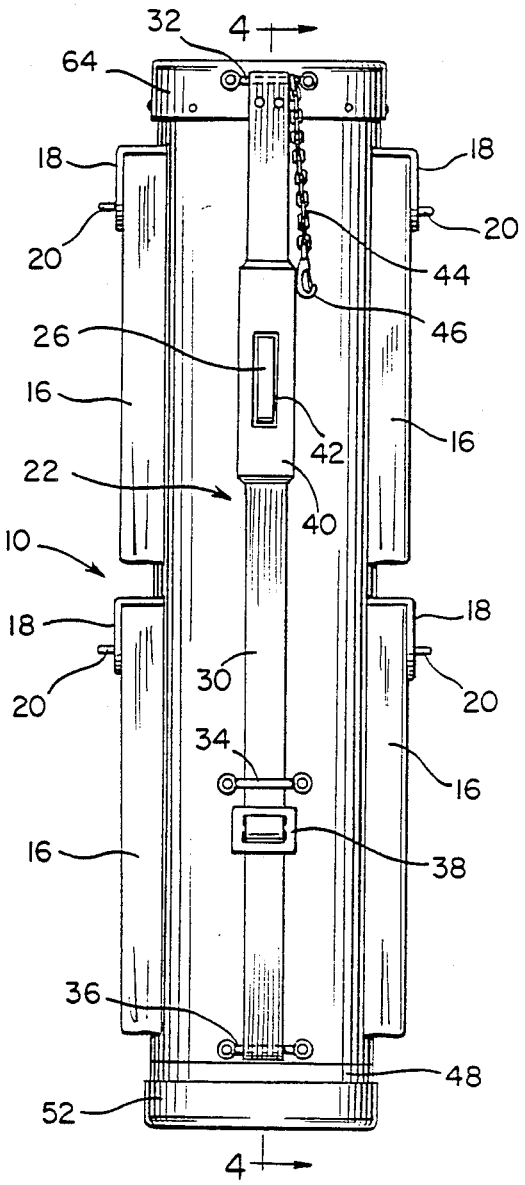
FIG. 2 is an elevational view of the bag from the opposite side.
Figure 3:
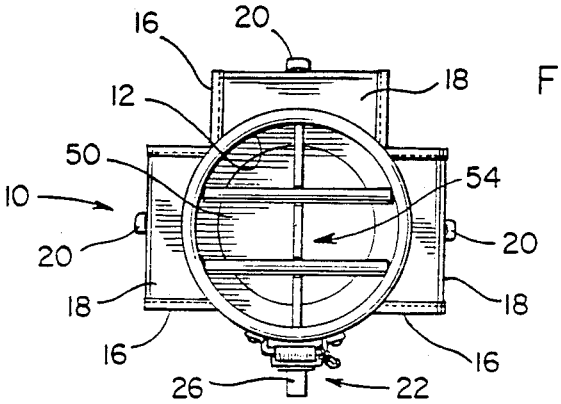
FIG. 3 is a plan view of the bag.
Figure 4:
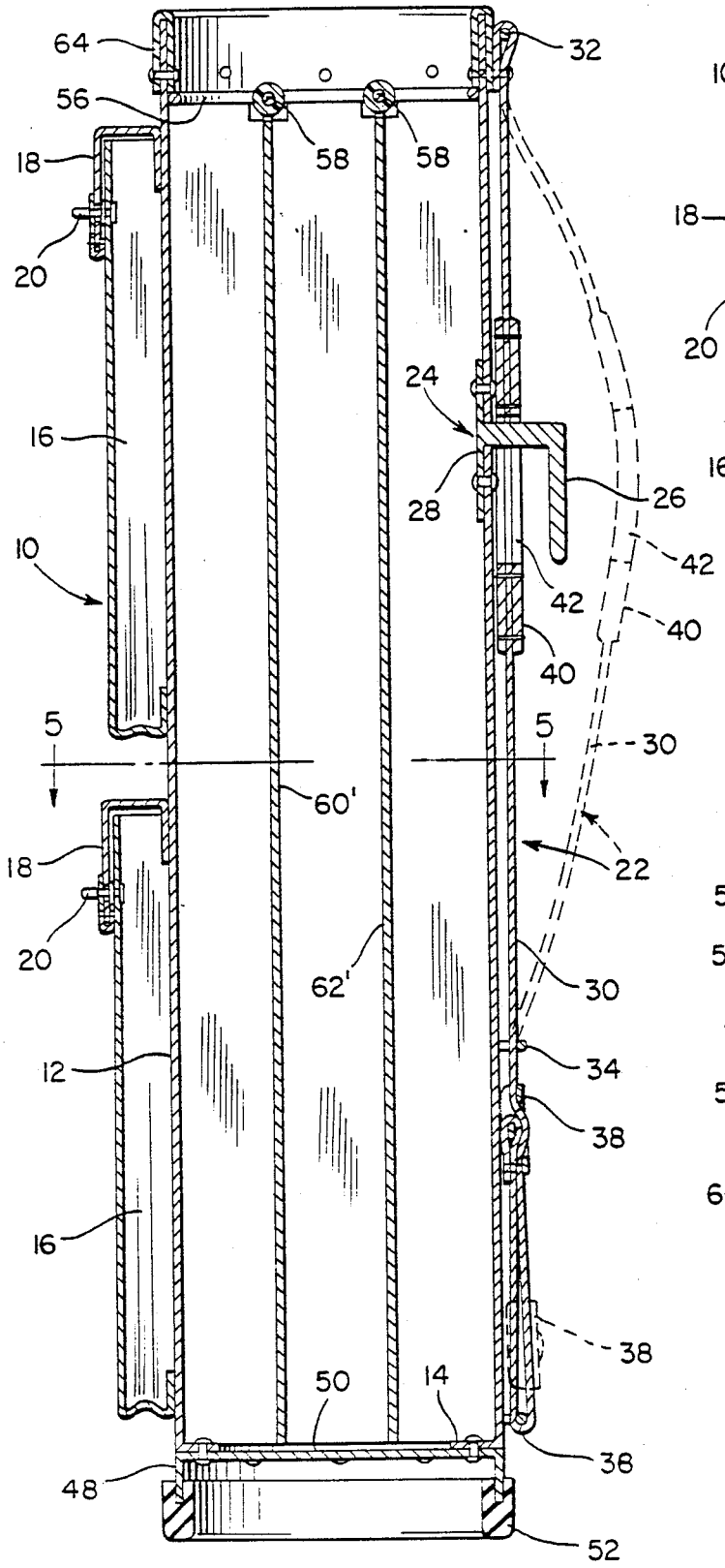
FIG. 4 is a sectional view on line 4—4 of FIG. 2.
Figure 5:
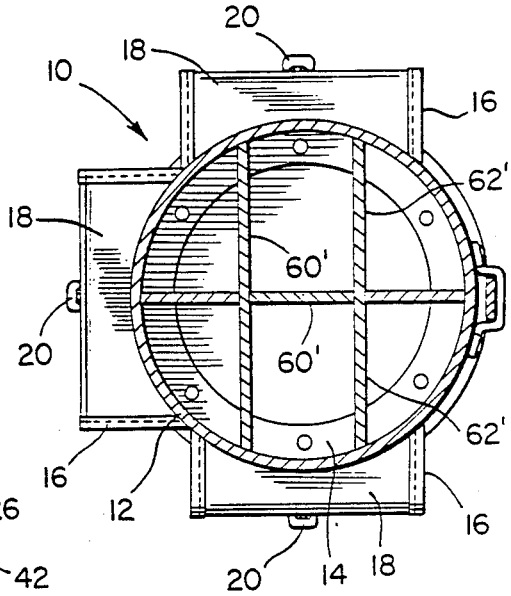
FIG. 5 is a sectional view on line 5—5 of FIG. 4.
Figure 6:
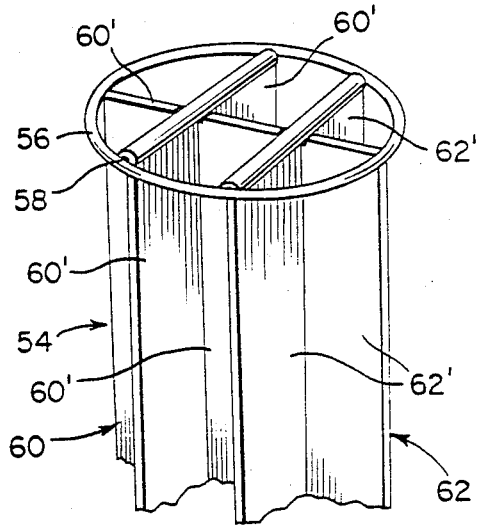
FIG. 6 is a perspective view of a part of a club divider assembly.

The illustrated golf bag 10 includes, for example, an inner support tube 12 which may be fabricated from lightweight metal or like sheet, and which has a base flange 14. The tube may be any convenient diameter commonly used in golf bags, for example, from about 8 inches to 10½ inches, and it may be covered with any suitable fabric or material covering of a type commonly used in golf bag manufacture. The bag is provided externally with pockets 16 on each of three sides, each pocket having a flap-top 18 and latch-type closure 20 as opposed to a zipper commonly used on golf bag pockets and which is subject to premature deterioration. The pockets may have subsidiary internal pockets to increase their capacity or versatility.

On the fourth side of the bag which is free of pockets, there is provided a shoulder strap assembly 22 and a carrying handle assembly 24, the handle assembly comprising, for example, a rigid handle 26 on a plate 28 riveted or similarly fastened to tube 12, so that handle 26 projects from the surface of the bag. Strap assembly 22 comprises a strap 30 of suitable webbing or other material having its upper end secured to a bracket 32 at the top of the bag. The strap passes under a guide bracket 34, around a further bracket 36 at the bottom of the bag, and its free end is secured to a buckle 38 which can slide along the strap between brackets 34 and 36, to adjust the looped length of the strap and thus also the length of strap above bracket 34 which is available for carrying purposes. To lengthen the amount of strap available for carrying purposes, buckle 38 is moved down toward bracket 36 and vice versa. Further, the strap includes a shoulder pad section 40 with a central slot 42 adapted to receive handle 26 therethrough. The length of the strap is such that when it is at its shortest, with buckle 38 adjacent bracket 34, the strap lies flush against the outside of the bag with handle 26 protruding through slot 42, so that the strap, when not required for carrying purposes, can be stored neatly against the bag and the bag can still be lifted and manipulated by handle 26. In an alternative embodiment, the carrying handle 26 may be attached to the exterior of shoulder pad section 40 of the strap rather than to the outside of the bag. A cart attachment chain 44 terminating in a snap hook 46 may be provided, as shown, on bracket 32 or other suitable attachment.

To flange 14 is secured, as by riveting, a base plate 50 with a depending rim 48. The rim is provided with a shock absorbing rubber or like bumper ring 52 spaced below plate 50. The ring absorbs impacts and protects the handles of clubs stored in the bag. The ring may be secured to the rim 48 as shown or may be secured inside of rim 48 by suitable fasteners.

A club divider assembly 54 is provided within tube 12 comprising a carrier ring 56 with cross bars 58 from which are suspended cruciform divided baffles 60, 62. Baffle 60 has four leaves 60' and baffle 62 has three leaves 62'. The ring 56 sets in tube 12 below a bag rim member 64. The upper end of the bag and/or the member 64 may be magnetized so that steel shaft clubs placed in the respective club compartments defined by the baffles can be held magnetically against the rim of the bag in an organized manner.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A golf bag comprising a tubular member defining an internal club carrying compartment, pocket means on the exterior of the tubular member for golf accessories, a length-adjustable shoulder strap on the exterior of the tubular member, the strap having a shortened stowing position wherein the strap lies substantially against the exterior of the tubular member, and means defining a rigid carrying handle protruding through the strap when the strap is in the stowing position.

2. A golf bag comprising a tubular member defining an internal club carrying compartment, pocket means on the exterior of the tubular member for golf accessories, a length-adjustable shoulder strap on the exterior of the tubular member, the strap having a shortened stowing position wherein the strap lies substantially against the exterior of the tubular member, and means defining a rigid carrying handle on the exterior of the tubular member and which protrudes through a slot in the strap when the strap is in the stowing position.

3. The invention of claim 2 wherein the strap has a shoulder pad portion and the slot is formed in the shoulder pad portion.

4. The invention of claim 2 wherein one end of the strap is secured to an upper bracket on the tubular member, the strap being looped around a lower bracket on the tubular member and having another end secured to a length adjustment buckle on the strap between said brackets.

5. The invention of claim 4 wherein the strap passes beneath a third bracket on the outside of the tubular member above the buckle.

6. The invention of claim 1 wherein the pocket means include separate pockets on three sides of the tubular member and the bandle and strap are located on a fourth side of the tubular member.

7. The invention of claim 6 wherein each pocket has a flap cover and closure latch.

8. The invention of claim 4 wherein the bag includes a chain and snap hook on said upper bracket for securing the bag on a golf cart.

9. A golf bag comprising a tubular member defining an internal club-carrying compartment, pocket means on the exterior of the tubular member for golf accessories, carrying means for the bag on the exterior of the tubular member wherein the tubular member has a base plate and a resilient shock-absorbing ring spaced below the base plate for cushioning impacts and protecting clubs within the club compartment and means defining a rigid handle protruding through said carrying means when said carrying means is in a stowing position.

10. The invention of claim 9 including club divider means in the tubular member wherein the divider means includes a ring adjacent a top opening of the tubular member, cross bars attached to the ring, and partition means suspended from the cross bars dividing the compartment into separate sections.

11. The invention of claim 10 wherein the partition means are of cruciform section.

12. The invention of claim 10 wherein an upper section of the bag defining said top opening is magnetized so as to magnetically attract steel shaft clubs in the compartment toward organized engagement around the interior of the tubular member.

13. A golf bag comprising a tubular member defining a club carrying compartment, pocket means on the exterior of the tubular member for golf accessories, carrying means on the exterior of the tubular member wherein the tubular member has an open upper rim portion which is magnetized for magnetically attracting steel shaft clubs within the compartment toward engagement around the interior of the rim portion, the carrying means having a length adjustable shoulder strap having a shortened stowing position wherein the strap lies against the exterior of the bag, and means defining a rigid carrying handle protruding through the strap when the strap is in the stowing position.

14. The invention as defined in claim 13 wherein the tubular member is made of lightweight metal sheet and has a metal base plate with a shock absorbing ring of resilient material spaced below the base plate.

15. The invention of claim 13 wherein the handle defining means is a rigid handle on the exterior of the tubular member which protrudes through a slot in the strap when the strap is in the stowing position.

* * * * *